US007066774B2

(12) United States Patent
Fargo et al.

(10) Patent No.: US 7,066,774 B2
(45) Date of Patent: Jun. 27, 2006

(54) ELECTRICAL CONNECTOR AND SLEEVE APPARATUS AND METHOD OF ASSEMBLY

(75) Inventors: Vincent P. Fargo, St. Charles, MO (US); Kent L. White, St. Louis, MO (US); Paul G. Michaels, St. Louis, MO (US); Jacob M. Olejniczak, O'Fallon, MO (US); William L. Riggs, Russellville, KY (US)

(73) Assignee: Emerson Electric Co., St. Louis, MO (US)

( * ) Notice: Subject to any disclaimer, the term of this patent is extended or adjusted under 35 U.S.C. 154(b) by 21 days.

(21) Appl. No.: 10/881,228

(22) Filed: Jun. 30, 2004

(65) Prior Publication Data

US 2006/0003630 A1 Jan. 5, 2006

(51) Int. Cl.
*H01R 4/10* (2006.01)

(52) U.S. Cl. ..... 439/877

(58) Field of Classification Search ..... 439/877, 439/886, 203, 730, 867, 882, 866; 174/84 C, 174/112

See application file for complete search history.

(56) References Cited

U.S. PATENT DOCUMENTS

| | | | | |
|---|---|---|---|---|
| 2,815,497 | A * | 12/1957 | Redslob | 439/203 |
| 3,112,150 | A | 11/1963 | Hammell | |
| 3,953,103 | A | 4/1976 | Mathis | |
| 4,815,200 | A | 3/1989 | Ito | |
| 4,840,578 | A | 6/1989 | Sato | |
| 4,947,568 | A * | 8/1990 | De Barbieri | 40/316 |
| 5,025,554 | A | 6/1991 | Dohi | |
| 5,408,048 | A | 4/1995 | Endo et al. | |
| 5,429,529 | A | 7/1995 | Hashizawa et al. | |
| 5,736,678 | A | 4/1998 | Kobayashi | |
| 5,908,326 | A | 6/1999 | Neuhauser et al. | |
| 5,965,847 | A | 10/1999 | Tanaka et al. | |
| 6,107,572 | A | 8/2000 | Miyazaki | |
| 6,410,853 | B1 | 6/2002 | Peters et al. | |
| 6,498,560 | B1 | 12/2002 | White et al. | |
| 6,666,732 | B1 * | 12/2003 | Endacott | 439/874 |

* cited by examiner

*Primary Examiner*—Phuong Dinh
(74) *Attorney, Agent, or Firm*—Thompson Coburn, LLP

(57) ABSTRACT

An electrical connector includes a terminal attached to a length of wiring that extends from the stator windings of an electrical device, and a tubular insulating sleeve that extends along the length of wiring. The sleeve is secured stationary relative to both the wiring and the terminal by being secured to the stator windings by the same mechanical connection that binds the stator windings.

13 Claims, 2 Drawing Sheets

ELECTRICAL CONNECTOR AND SLEEVE APPARATUS AND METHOD OF ASSEMBLY

BACKGROUND OF THE INVENTION (1) Field of the Invention

The present invention pertains to an electrical connector that includes a terminal attached to a length of wiring that extends from the stator windings of an electric motor, and a tubular insulating sleeve that extends along the length of wiring. The sleeve is secured stationary relative to both the wiring and the terminal by being secured to the stator windings by the same mechanical connection that binds the stator windings.

(2) Description of the Related Art

Current electrical connector assemblies, such as that disclosed in the U.S. patent of Peters, et al., U.S. Pat. No. 6,410,853, are well-designed for their intended functions. A connector assembly of this type is often employed on the lead wires of an electric motor. The assembly includes a terminal that is secured to the motor lead wire. The terminal is removably attachable to a separate electrical coupling to communicate the motor stator windings with the electrical coupling.

However, problems have been encountered in the assembly of electrical connectors of the type disclosed in the above-referenced patent. The electric terminal of the connector assembly has a lead wire crimp and an insulation sleeve crimp. Lead wires are secured to the terminal at the lead wire crimp, and a tubular insulating sleeve is secured to the terminal at the sleeve crimp. However, at times lead wires secured to the terminal are damaged and/or cut at the insulation sleeve crimp. In addition, at times the lead wires and sleeve are incorrectly placed into the terminals. For example, the insulation sleeve is at times crimped in the lead wire crimp area of the terminal, and on occasion the insulation sleeve is left out of the insulation crimp of the terminal when the crimp is formed. Broken lead wires have also been encountered at the lead dwell of the stator casing where the lead wires enter the motor housing.

Some of the problems encountered in the use of the prior art electrical connector are attributed to the assembly of the connector. In assembling the connector, the operator must place the lead wires to be crimped to the electric terminal in the wire crimp portion of the terminal, and must place the distal end of the insulation sleeve into the insulation crimp portion of the terminal. The operator then activates a press, crimping both the lead wires and the insulation sleeve simultaneously to the terminal. Thus, the operators are required to place both the lead wires and the outer insulation sleeve into the terminal at the same time. They also must keep the lead wires fully in the wire crimp portion of the terminal, not letting the wires cross or twist. At the same time, the outer insulation sleeve must be kept out of the wire crimp portion of the terminal, and must be positioned in the insulation crimp portion of the terminal. This all occurs within a two inch opening of the crimping machine.

SUMMARY OF THE INVENTION

The electrical connector apparatus of the present invention and its method of assembly overcome the disadvantages of prior art electrical connectors described above. The electrical connector apparatus of the invention eliminates the insulation sleeve crimp from the prior art terminal. In lieu of the sleeve connection at the terminal, the sleeve is provided with a sufficient length to allow the proximal end of the sleeve to be secured to the electrical device, i.e., the stator windings of the electrical motor. In this way, the insulation sleeve distal end is held stationary relative to the electric terminal at the opposite end of the electrical device wire. This construction of the electrical connector apparatus of the invention, and its method of assembly allows the operator assembling the connector apparatus to concentrate on the placement of the electrical device wire in the electric terminal, simplifies the construction of the terminal to facilitate proper placement of the wire in the terminal, and adds the additional protection of the insulation sleeve over the wire at the lead dwell where the wire enters the electrical device.

BRIEF DESCRIPTION OF THE DRAWINGS

Further features of the invention are set forth in the following detailed description of the preferred embodiment of the invention, and in the following drawing figures wherein.

DETAILED DESCRIPTION OF THE PREFERRED EMBODIMENT

Figure 1:
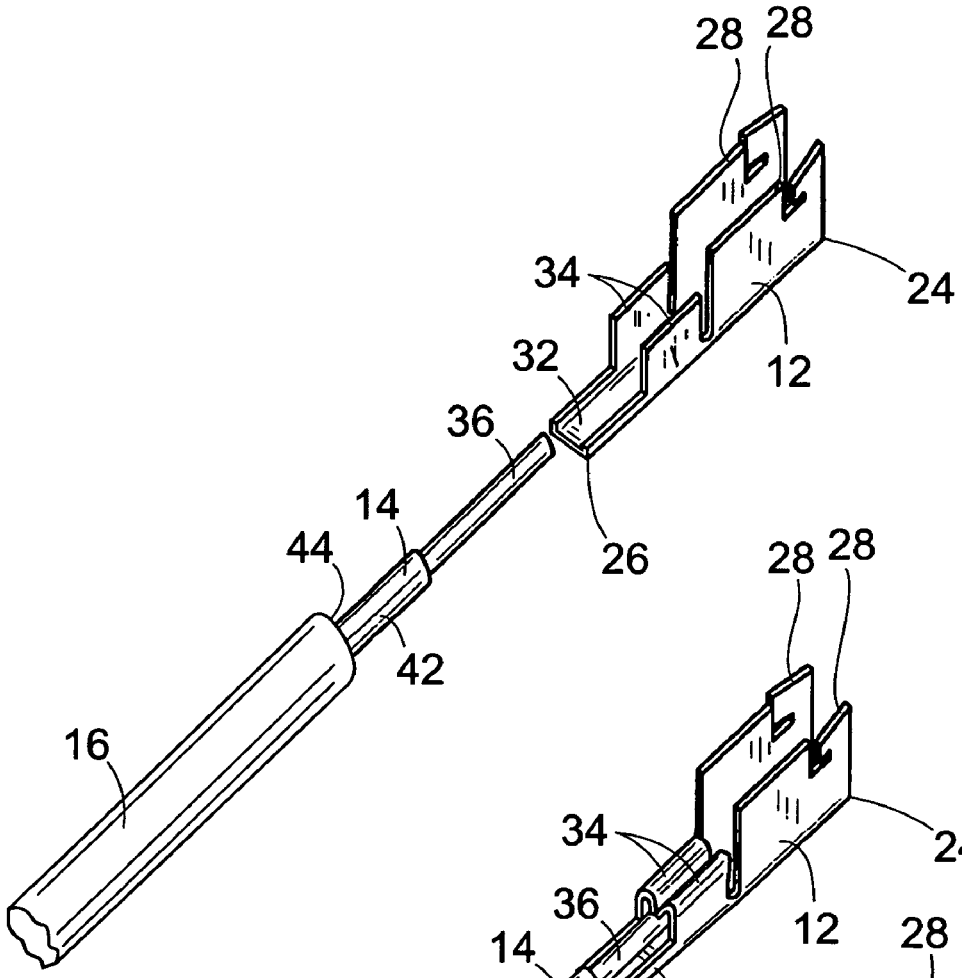
FIG. 1 is a perspective view of the electrical connector apparatus of the invention prior to the attachment of the electrically conductive terminal to the conductive wire of the apparatus.

The electrical connector apparatus of the invention is basically comprised of an electrically conductive terminal (12), a length of electrically conductive wire (14), a tubular insulating sleeve (16), and a mechanical connection (18) employed in connecting the length of wire (14) to an electrical device, such as an electric motor (22).

The conductive terminal (12) is constructed of an electrically conductive material, for example a metal. As shown in the drawing figures, the terminal (12) has a length with an attaching end (24) at a distal end of its length and a connection end (26) at an opposite, proximal end of its length. The terminal (12) is shown in the drawing figures having a general U-shape cross section. The terminal attaching end (24) is formed with pairs of flanges (28) that are adapted for connecting the terminal (12) to a separate electrical coupling. The configurations of the attaching flanges (28) at the terminal attaching end (24) are illustrative only and should not be interpreted as limiting the terminal attaching flanges (28) to any particular configuration. The terminal connection end (26) is formed with a flat, narrow tab (32) that projects from the terminal. The terminal is also provided with a pair of crimping flanges (34). The crimping flanges (34) are positioned at the terminal connection end (26) between the tab (32) and the terminal attaching flanges (28). The terminal crimping flanges (34) are employed in connecting the terminal (12) to the conductive wire (14).

Figure 2:
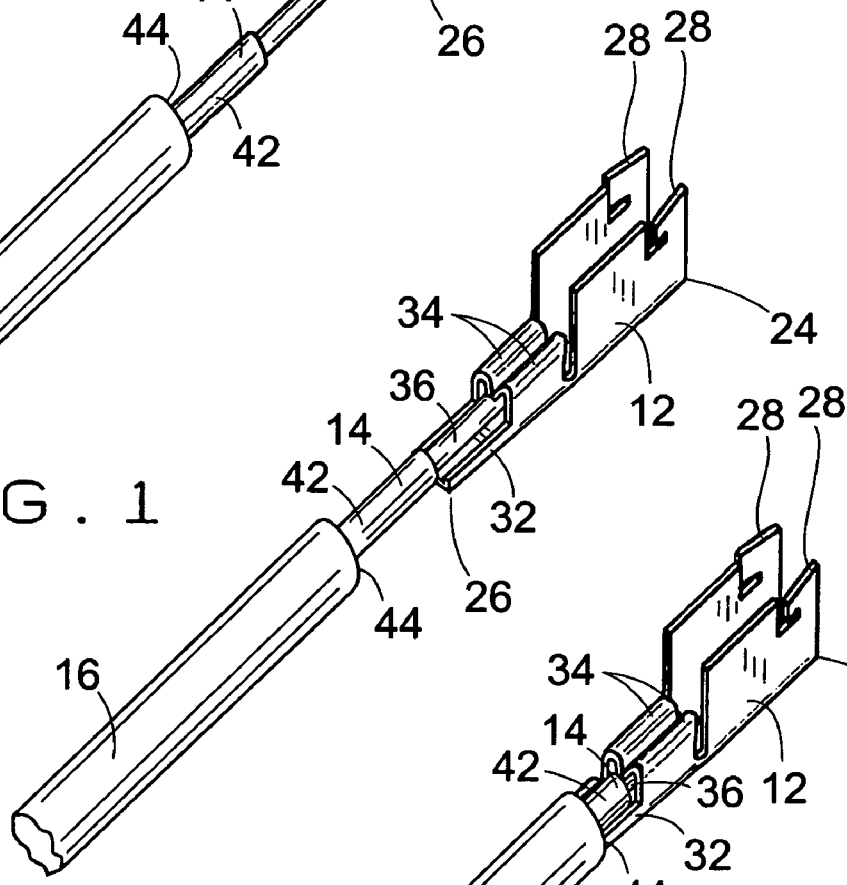
FIG. 2 is a perspective view similar to FIG. 1, but showing the terminal secured to the wire.
Figure 3:
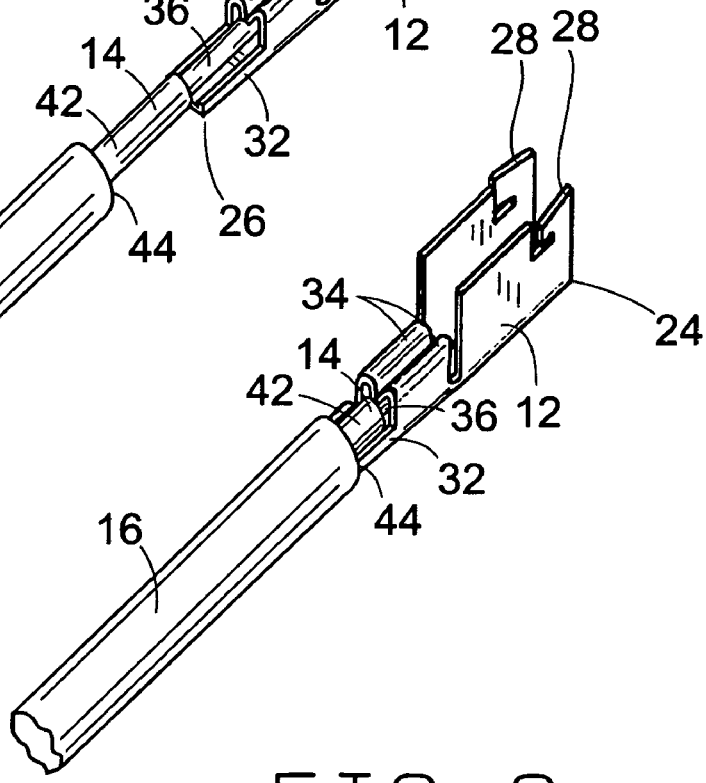
FIG. 3 is a perspective view similar to FIG. 2, but showing the stationary position of the insulation sleeve distal end relative to the wire distal end and relative to the terminal.
Figure 4:
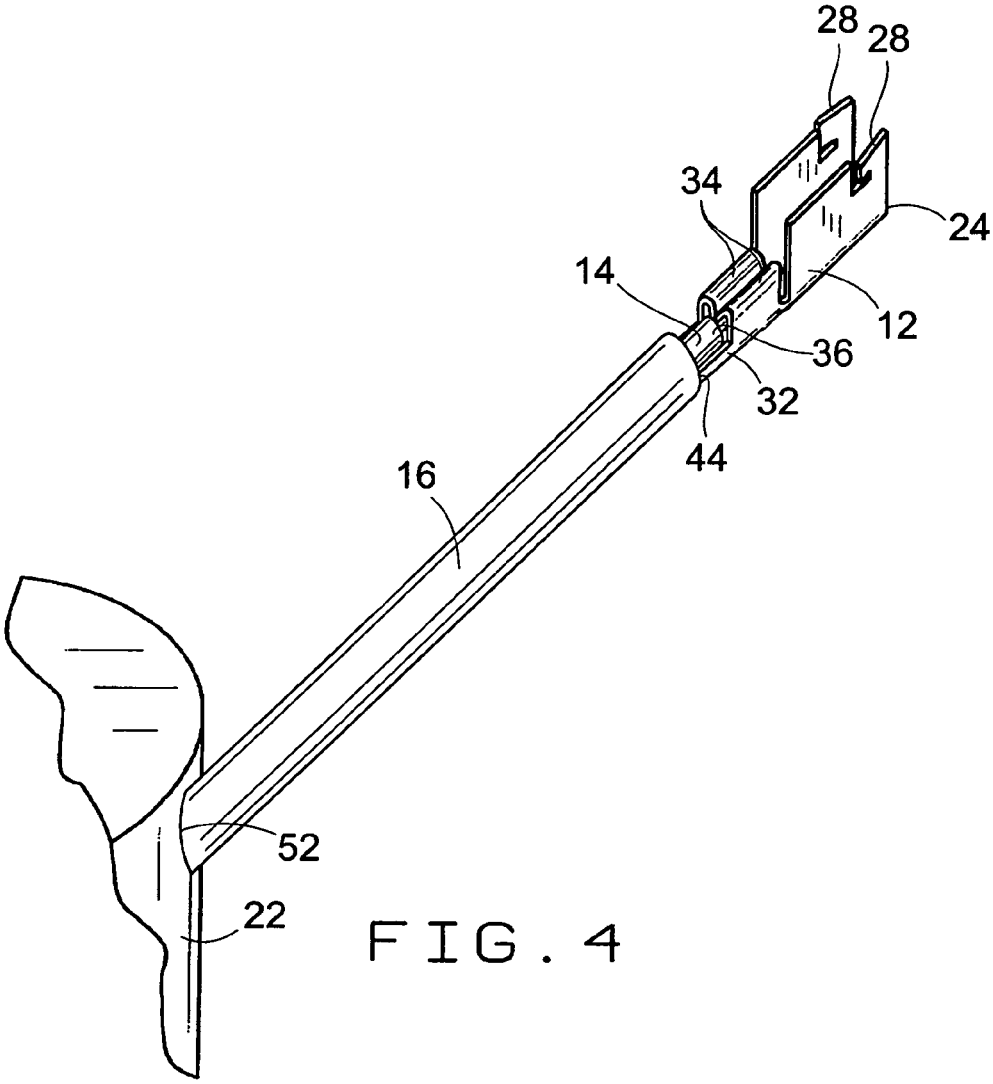
FIG. 4 is a perspective view similar to FIG. 3, but showing the electrical connector apparatus on a wire of an electric motor; and, FIG. 5 is a partial view of the proximal end of the electrical connector apparatus connected to the stator end turns of the electric motor.

The length of electrically conductive wire (14) can be any standard type of wire typically used in conducting electrical power to an electrical device. The wire (14) has a length with opposite distal (36) and proximal (38) ends. The wire is shown in the drawing figures having a layer of insulation (42) surrounding a majority of the wire except for a portion of the wire distal end (36). In alternate embodiments of the apparatus, the entire length of the wire (14) could be without an insulation layer. The wire (14) could also be two or more strands of wire. As shown in FIGS. 2, 3 and 4, the distal end portion (36) of the wire is secured to the conductive terminal (12) by being crimped between the crimping flanges (34). The distal end portion (36) of the wire extends from the crimping flanges (34) across the terminal tab (32) to the proximal end (38) of the wire. The wire proximal end (38) is connected to the electrical device (22).

The tubular insulating sleeve (16) is mounted to the length of wire (14) for sliding movement of the sleeve along the wire. In the preferred embodiment, the sleeve (16) has a length between a distal end (44) and an opposite proximal end (46) of the sleeve that is just slightly shorter than the length of the wire (14). As shown in the drawing figures, the sleeve distal end (44) is positioned adjacent the wire distal end (36) when the wire is attached to the terminal (12) by the crimping flanges (34). Following attachment of the wire distal end (36) to the terminal (12) by the crimping flanges (34), the sleeve (16) is moved over the wire (14) so that the sleeve distal end (44) extends over the terminal tab (32) and is positioned adjacent the crimping flanges (34). In this manner, the sleeve distal end (44) surrounds and protects the exposed portion of the wire distal end (36) immediately adjacent the connection of the wire distal end to the terminal crimping flanges (34). With the length of the sleeve (16) advanced over the wire (14) toward the terminal (12), the sleeve proximal end (46) is positioned adjacent the wire proximal end (38).

Figure 5:
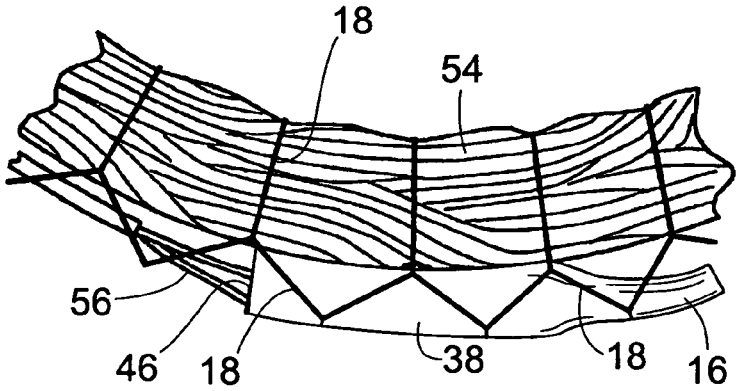

FIG. 4 shows the length of the wire (14) and the insulating sleeve (16) extending through a dwell opening (52) of the electrical device (22). In the illustrative example, the electrical device (22) is an electric motor having a plurality of electrical conductor windings, for example stator windings (54). As shown in FIG. 5, the wire proximal end (38) is connected to leads (56) of the electrical conductor windings (54). The connection to the leads (56) is made at the sleeve proximal end (46).

The electrical conductor windings (54) are shown in FIG. 5 being secured or bound together by a connection (18). The connection (18) also secures the sleeve proximal end (46) to the electrical device (22) by securing the sleeve proximal end (46) to the electrical conductor windings (54). In the illustrative embodiment, the connection of the sleeve proximal end (46) to the electrical device (22) is provided by a mechanical connection (18) that also binds the electrical conductor windings (54). This simplifies the construction of the connector and sleeve apparatus. The mechanical connection (18) is provided by the same lacings that both bind together the electrical conductor windings (54) and secure the sleeve proximal end (46) to the electrical device (22). In alternate embodiments, other types of mechanical connections could be provided to both bind together the electrical conductor windings (54) and secure the sleeve proximal end (46) to the electrical device (22). Examples of other types of mechanical connectors are adhesives, insulating wrappings around the conductor windings, pull ties, and other equivalent methods of both binding together the electrical conductor windings (54) and securing the sleeve proximal end (46) to the electrical device (22). In each of these examples, the sleeve(16) is secured stationary relative to the electrical terminal (12) by the connection of the sleeve proximal end (46) to the electrical device (22).

It can be seen from the description of the construction of the electrical connector apparatus of the invention, and its method of assembly set forth above, that the assembling of the connector apparatus allows the operator to concentrate on the placement of the conductive wire in the electric terminal, simplifies the construction of the terminal to facilitate proper placement of the wire in the terminal, and adds the additional protection of the insulation sleeve over the wire at the lead dwell where the wire enters the electrical device.

The invention claimed is:

1. An electrical connector apparatus comprising:

an electrically conductive wire having a length with opposite proximal and distal ends;

an electrically conductive terminal having an attaching end that is adapted for attaching the terminal to a separate electrical coupling, and a connection end that is electrically connected to the wire distal end;

a tubular insulating sleeve that is mounted on the wire for sliding movement of the sleeve along the wire length, the sleeve having opposite proximal and distal ends, and the sleeve distal end extending over a portion of the terminal connection end;

the terminal connection end having a crimped portion connecting the terminal to the wire distal end;

the sleeve distal end extending over the portion of the terminal connection end and not over the terminal crimped portion;

an electrical device;

the wire extending from the electrical device with the wire proximal end being connected to the electrical device; and, the sleeve proximal end being secured to the electrical device.

2. The apparatus of claim 1, further comprising:

the sleeve distal end being on one side of the terminal crimped portion and the terminal attaching end being on an opposite side of the terminal crimped portion.

3. The apparatus of claim 1, further comprising:

the electrical device being an electric motor, the motor having stator windings; and lacing binding together the stator windings and securing the sleeve proximal end to the motor.

4. An electrical connector apparatus comprising:

an electrically conductive wire having a length with opposite proximal and distal ends;

an electrically conductive terminal having an attaching end that is adapted for attaching the terminal to a separate electrical coupling, and a connection end that is electrically connected to the wire distal end;

a tubular insulating sleeve that is mounted on the wire for sliding movement of the sleeve alone the wire length, the sleeve having opposite proximal and distal ends, and the sleeve distal end extending over a portion of the terminal connection end;

an electrical device;

the wire extending from the electrical device with the wire proximal end being connected to the electrical device; and, the sleeve proximal end being secured to the electrical device to prevent sliding movement of the sleeve on the wire.

5. The apparatus of claim 4, further comprising:

the electrical device having electrical conductor windings and the wire proximal end being electrically connected to the electrical conductor windings; and, the sleeve proximal end being secured to the electrical conductor windings.

6. The apparatus of claim 5, further comprising:

lacing binding together the electrical conductor windings and securing the sleeve proximal end to the electrical conductor windings.

7. The apparatus of claim 4 further comprising:

the sleeve distal end not being secured to the wire or to the terminal.

8. An electrical connector apparatus comprising:

an electrically conductive wire having a length with opposite proximal and distal ends;

an electrically conductive terminal having an attaching end that is adapted for attaching the terminal to a separate electrical coupling, and a connection end that is electrically connected to the wire distal end;

an electrical device that is electrically connected to the wire proximal end; and, a tubular insulating sleeve having a length with opposite proximal and distal ends, the sleeve being mounted on the wire for sliding movement of the sleeve along the wire length, the sleeve distal end being adjacent the electrically conductive terminal and the sleeve proximal end being secured to the electrical device.

9. The apparatus of claim 8, further comprising:

a mechanical connection engaging with the sleeve proximal end and securing the sleeve proximal end to the electrical device and preventing sliding movement of the sleeve over the wire length.

10. The apparatus of claim 9, further comprising:

the electrical device having electrical conductor windings and the wire proximal end being electrically connected to the electrical conductor windings; and, the sleeve proximal end being secured to the electrical conductor windings by the mechanical connection.

11. The apparatus of claim 10, further comprising:

the mechanical connection binding together the electrical conductor windings and securing the sleeve proximal end to the electrical conductor windings.

12. The apparatus of claim 8, further comprising:

the sleeve distal end not being secured to the wire or to the terminal.

13. The apparatus of claim 8, further comprising:

the sleeve distal end extending over a portion of the terminal.

* * * * *